US008797162B2

(12) United States Patent
Chang et al.

(10) Patent No.: US 8,797,162 B2
(45) Date of Patent: Aug. 5, 2014

(54) ANTI-THEFT SYSTEM USING RFID TAGS

(75) Inventors: Hsin-Pei Chang, New Taipei (TW); Zong-Yuan Sun, New Taipei (TW); Da-Hua Xiao, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 101 days.

(21) Appl. No.: 13/596,037

(22) Filed: Aug. 27, 2012

(65) Prior Publication Data

US 2013/0135106 A1 May 30, 2013

(30) Foreign Application Priority Data

Nov. 28, 2011 (CN) ..... 2011 1 0383671

(51) Int. Cl.
*G08B 13/14* (2006.01)

(52) U.S. Cl.
USPC ..... 340/572.1; 340/10.1; 340/10.2; 340/10.3; 340/10.31; 340/10.32; 340/10.33; 340/10.34; 340/10.4; 340/10.41; 340/10.42; 340/10.5; 340/10.52; 340/10.6; 340/572.2; 340/572.3; 340/572.4; 340/572.5; 340/572.6; 340/572.7; 340/572.8; 340/572.9; 235/375; 235/376; 235/377; 235/378; 235/379; 235/380; 235/381; 235/382; 235/383; 235/384; 235/385

(58) Field of Classification Search
USPC ..... 340/10.1–10.6, 572.1–572.9; 235/375–385
See application file for complete search history.

(56) References Cited

U.S. PATENT DOCUMENTS

| | | | | |
|---|---|---|---|---|
| 6,198,381 | B1 * | 3/2001 | Turner et al. | 340/10.1 |
| 7,529,533 | B2 * | 5/2009 | Bellantoni | 455/334 |
| 7,969,282 | B2 * | 6/2011 | Powell et al. | 340/10.2 |
| 8,120,464 | B2 * | 2/2012 | Bang et al. | 340/10.1 |
| 8,487,769 | B2 * | 7/2013 | Lindsay et al. | 340/572.3 |
| 8,570,174 | B2 * | 10/2013 | Sayegh et al. | 340/572.1 |
| 2007/0139162 | A1 * | 6/2007 | Bandy et al. | 340/10.2 |
| 2007/0139163 | A1 * | 6/2007 | Powell et al. | 340/10.2 |
| 2007/0178935 | A1 * | 8/2007 | Shim et al. | 455/552.1 |
| 2007/0194886 | A1 * | 8/2007 | Bang et al. | 340/10.1 |
| 2008/0007398 | A1 * | 1/2008 | DeRose et al. | 340/539.13 |
| 2009/0085743 | A1 * | 4/2009 | Ravi et al. | 340/572.1 |
| 2009/0146800 | A1 * | 6/2009 | Grimlund et al. | 340/505 |
| 2010/0130140 | A1 * | 5/2010 | Waku et al. | 455/77 |

(Continued)

FOREIGN PATENT DOCUMENTS

JP 2009009520 A * 1/2009

*Primary Examiner* — George Bugg
*Assistant Examiner* — Paul Obiniyi
(74) *Attorney, Agent, or Firm* — Novak Druce Connolly Bove + Quigg LLP

(57) ABSTRACT

A detection unit positioned on a package includes a magnet, a first magnetic switch, a second magnetic switch, a processor, and a clock. The first magnetic switch outputs a first control signal or a second control signal according to magnetic flux density of the magnet. The second magnetic switch outputs a third control signal or a fourth control signal according to the magnetic flux density of the magnet. The first control signal is the same as the third control signal; the second control signal is the same as the fourth control signal. When the processor receives the first control signal and the third control signal at the same time, the processor reads a first real-time clock (RTC) signal from the clock. When the processor receives the second control signal and the fourth control signal at the same time, the processor reads a second RTC signal from the clock.

13 Claims, 2 Drawing Sheets

(56) References Cited

U.S. PATENT DOCUMENTS

2011/0273295 A1* 11/2011 Sayegh et al. ..... 340/572.1
2012/0032803 A1* 2/2012 Copeland et al. ..... 340/572.1
2012/0161941 A1* 6/2012 Park et al. ..... 340/10.5
2012/0235795 A1* 9/2012 Liao et al. ..... 340/10.1
2013/0099928 A1* 4/2013 Daly et al. ..... 340/573.1
2013/0234832 A1* 9/2013 Manzi ..... 340/10.2
2013/0264388 A1* 10/2013 Grimlund et al. ..... 235/385
2014/0012439 A1* 1/2014 Dimmer et al. ..... 701/19

* cited by examiner

ANTI-THEFT SYSTEM USING RFID TAGS

CROSS-REFERENCE TO RELATED APPLICATIONS

This application is one of the three related co-pending U.S. patent applications listed below. All listed applications have the same assignee. The disclosure of each of the listed applications is incorporated by reference into each of the other listed applications.

| Attorney Docket No. | Title | Inventors |
|---|---|---|
| US 42979 | ARTICLE-TRACKING SYSTEM AND METHOD USING RFID TAGS | HSIN-PEI CHANG et al. |
| US 43084 | ARTICLE-TRACKING SYSTEM AND METHOD USING RFID TAGS | HSIN-PEI CHANG et al. |
| US 43160 | ANTI-THEFT SYSTEM USING RFID TAGS | HSIN-PEI CHANG et al. |

BACKGROUND

1. Technical Field

The disclosure generally relates to an anti-theft system, and particularly relates to an anti-theft system using radio frequency identification (RFID) tags.

2. Description of the Related Art

Tracking and verification of articles has greatly evolved in transportation business through the use of RFID tags. RFID tags can be attached to articles and be packed in a package (e.g., a box). However, the articles in the boxes may be stolen or replaced by fakes during the transportation process because anyone can open the package without detection before delivery of the package, and this will cause economic loss for manufacturers and sellers.

Therefore, there is room for improvement within the art.

BRIEF DESCRIPTION OF THE DRAWINGS

Many aspects of an exemplary anti-theft system using RFID tags can be better understood with reference to the drawings. The components in the drawings are not necessarily drawn to scale, the emphasis instead being placed upon clearly illustrating the principles of the disclosure.

DETAILED DESCRIPTION

Figure 1:
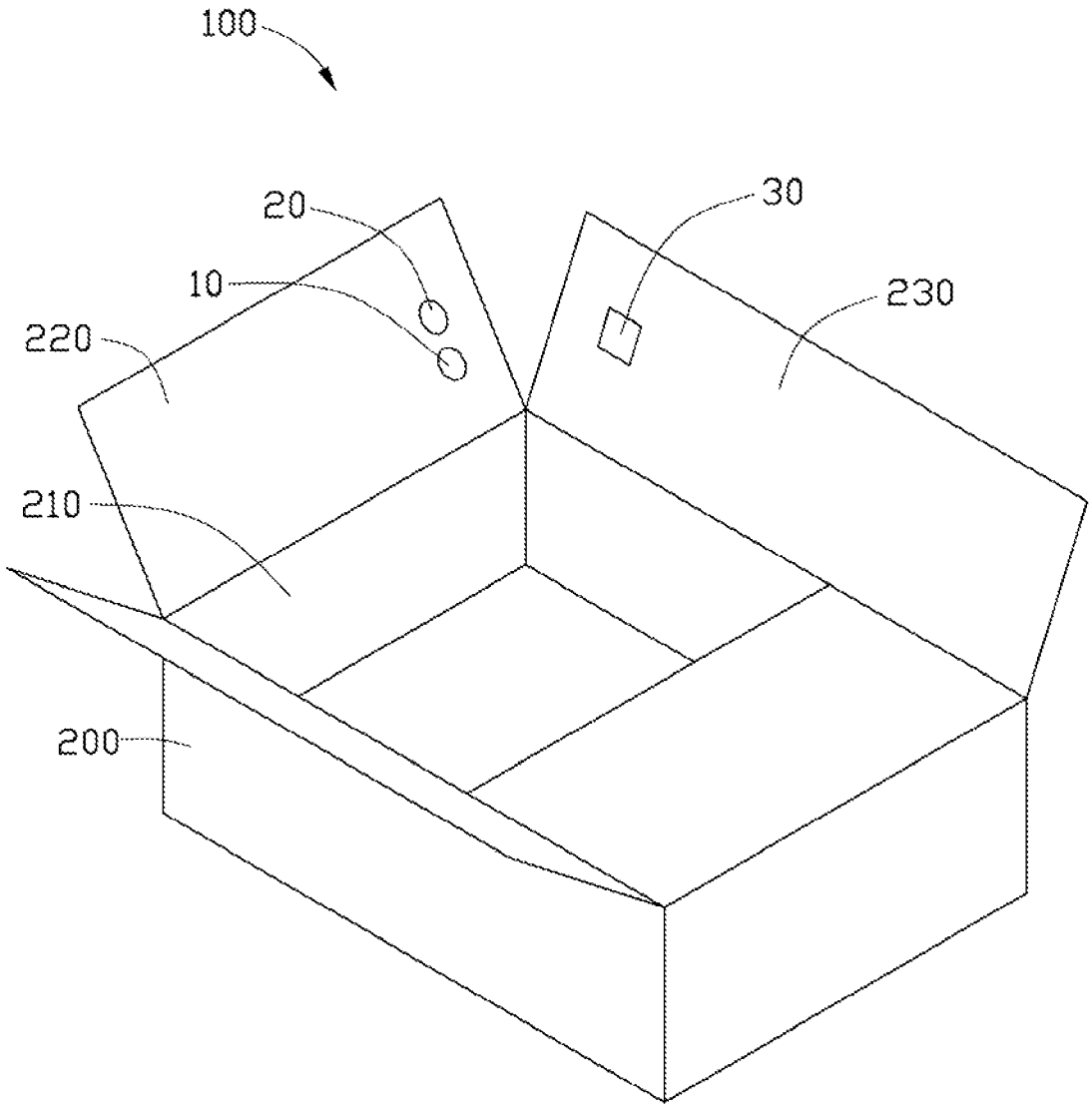
FIG. 1 is a schematic view of an anti-theft system using RFID tags, according to an exemplary embodiment.

FIG. 1 is a schematic view of an anti-theft system 100 using RFID tags, according to an exemplary embodiment. The anti-theft system 100 is used in a package 200 for preventing articles in the package 200 from being stolen or replaced. The anti-theft system 100 can track articles by means of RFID tags included during packing, transportation, and verification processes of the articles. The anti-theft system 100 includes a detection unit 300. The articles can be of any size and any value, such as luxury cigarettes, clothes, computers, or confidential files, for example.

The package 200 can be a box or any suitable storage container to accommodate the articles. In one exemplary embodiment, the package 200 includes an opening 210 into which the articles are packed in the package 200. The package 200 further includes two opposite and parallel first covers 220 and two opposite and parallel second covers 230. The two first covers 220 and the two second covers 230 are arranged alternately, and are hinged to the package 200 for selectively opening or covering the opening 210.

Figure 2:
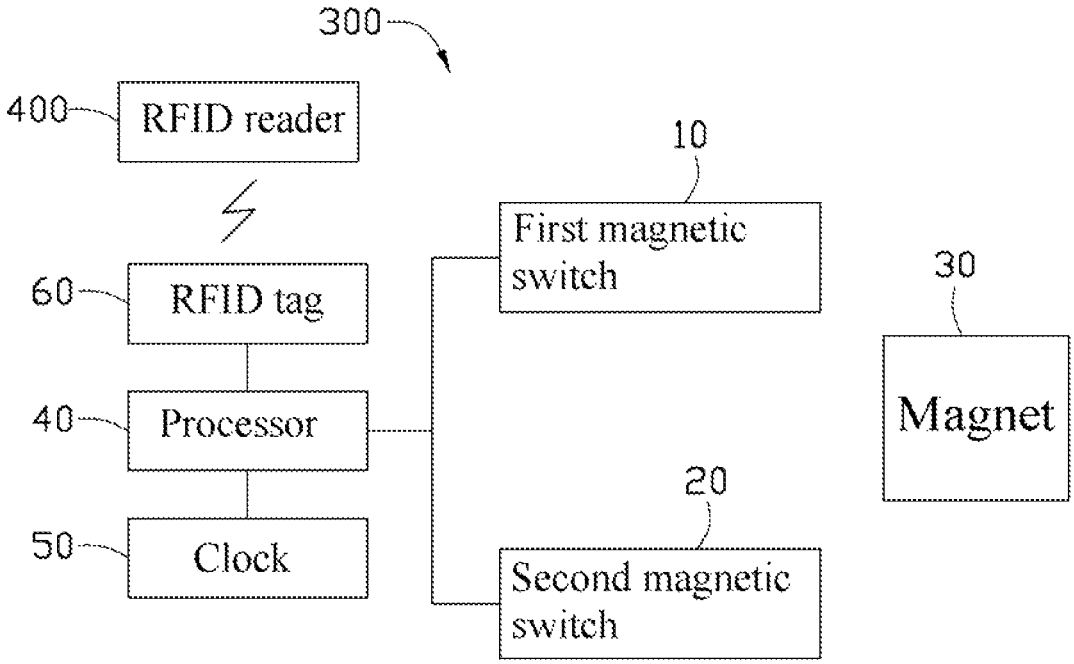
FIG. 2 is a block diagram of a detection unit of the anti-theft system using RFID tags as shown in FIG. 1.

Also referring to FIG. 2, parts of the detection unit 300 can be positioned on the first cover 220 and the second cover 230. It is understandable that the parts of the detection unit 300 may be positioned at any position adjacent to the opening 210 of the package 200. The detection unit 300 includes a first magnetic switch 10, a second magnetic switch 20, a magnet 30, a processor 40, a clock 50, and a RFID tag 60. The processor 40 is electronically connected to the clock 50 and the RFID tag 60.

In one exemplary embodiment, the first magnetic switch 10 is a Hall switch, and is positioned at one of the first covers 220. The first magnetic switch 10 predetermines a first magnetic threshold, for example, about 20 gauss (GS). As long as a magnetic flux density of a magnetic field applied to the first magnetic switch 10 is greater than the first predetermined magnetic threshold, the first magnetic switch 10 is enabled, and a first control signal is output. The first control signal may be a digital signal such as logic "0", or an analog voltage signal of 3V. If the magnetic flux density becomes less than the first predetermined magnetic threshold, the first magnetic switch 10 is disabled and a second control signal is output. The second control signal may be a digital signal such as logic "1", or an analog voltage signal of 5V.

The second magnetic switch 20 is also a Hall switch, and is positioned at the first cover 220 adjacent to the first magnetic switch 10. The second magnetic switch 10 predetermines a second magnetic threshold. The second predetermined magnetic threshold is greater than the first predetermined magnetic threshold of the first magnetic switch 10, and is, for example, about 230 GS. As long as a magnetic flux density of a magnetic field applied to the second magnetic switch 20 is greater than the second predetermined magnetic threshold, the second magnetic switch 10 is enabled, and a third control signal is output. The third control signal may be a digital signal such as logic "0", or an analog voltage signal of 3V. If the magnetic flux density becomes less than the second predetermined magnetic threshold, the second magnetic switch 20 is disabled, and a fourth control signal is output. The fourth control signal may be a digital signal such as logic "1", or an analog voltage signal of 5V.

The magnet 30 is positioned at one of the second covers 230, and is very close to the first magnetic switch 10 and the second magnetic switch 20 when the package 200 is closed. A magnetic flux density of the magnet 30 applied to the first magnetic switch 10 and the second magnetic switch 20 is different depending on whether the package 200 is opened or closed. Specifically, the magnetic flux density of the magnet 30 applied to the first magnetic switch 10 and the second magnetic switch 20 when the package 200 is closed is greater than the first predetermined magnetic threshold of the first magnetic switch 10 and less than the second predetermined magnetic threshold of the second magnetic switch 20. In one exemplary embodiment, the magnetic flux density is about 160 GS when the second cover 230 becomes substantially coplanar with the first cover 220. The magnetic flux density of the magnet 30 applied on the first magnetic switch 10 becomes less than the first predetermined magnetic threshold when the package 200 is opened. In one exemplary embodiment, the magnetic flux density is about 10 GS when the second cover 230 stands open relative to the first cover 220.

The processor 40 is electronically connected to the first magnetic switch 10 and the second magnetic switch 20 for receiving signals output from the first magnetic switch 10 and the second magnetic switch 20. The processor 40 reads a real-time clock (RTC) signal from the clock 50 when the processor 40 receives the first and the third control signals, or when it receives the second and the fourth control signals. The processor 40 further transmits the RTC signal to the RFID tag 60, to allow the RFID tag 60 to send the RTC signal to a RFID reader 400 via radio frequency (RF) signals.

When the package 200 is closed in a first place, such as at a factory, the second cover 230 is overlapped on the first cover 220, and the magnet 30 is adjacent to the first magnetic switch 10 and the second magnetic switch 20. At this time, the magnetic flux density of the magnet 30 is greater than the first predetermined magnetic threshold of the first magnetic switch 10, and is less than the second predetermined magnetic threshold of the second magnetic switch 20. Thus, the first magnetic switch 10 outputs the first control signal, and the second magnetic switch 20 outputs the fourth control signal, and then the processor 40 takes no action.

When the package 200 is opened, the magnet 30 moves far away from the first magnetic switch 10 and the second magnetic switch 20. At this time, the magnetic flux density applied to the first magnetic switch 10 and the second magnetic switch 20 drops sharply, and is less than the first predetermined magnetic threshold and the second predetermined magnetic threshold. Thus, the first magnetic switch 10 outputs the second control signal, and the second magnetic switch 20 continues to output the fourth control signal. Upon receiving the second control signal and the fourth control signal together, the processor 40 is activated to read the RTC signal from the clock 50, and transmit the RTC signal to the RFID tag 60.

If the second magnetic switch 20 is omitted, a stronger magnet (for example, a magnet of about 1500 GS) may be used. At this time, the first magnetic switch 10 will always be enabled whether the package 200 is opened or closed, and the processor 40 would thus take no action. In this case, the anti-theft system 100 would be inoperative, and the articles may easily be stolen or replaced. However, due to the existence of the second magnetic switch 20, if one then opens the package 200 which uses the stronger magnet, both the first magnetic switch 10 and the second magnetic switch 20 will be enabled to output the first and the third control signals together, and the processor is thus activated and functioning.

During the verification process of the article(s), the RFID tag 60 sends the RTC signal from the processor 40 to the RFID reader 400 via RF communication.

The anti-theft system 100 can detect whether the package 200 is opened, by means of the first magnetic switch 10 and the second magnetic switch 20. If the package 200 is opened, the first magnetic switch 10 outputs the first control signal, and the second magnetic switch 20 outputs the third control signal, or the first magnetic switch 10 outputs the second control signal, and the second magnetic switch 20 outputs the fourth control signal. Thus, the processor 40 reads the RTC signal from the clock, and the RFID tag 60 sends the RTC signal to the RFID reader 400 accordingly. Therefore, the end-user, in cooperation with manufacturers and sellers, can directly know when and how many times the package 200 has been opened according to the RTC signal, and the tracking of articles is sufficient to efficiently protect the articles from being stolen or replaced by fakes.

It is to be understood, however, that even though numerous characteristics and advantages of the exemplary disclosure have been set forth in the foregoing description, together with details of the structure and function of the exemplary disclosure, the disclosure is illustrative only, and changes may be made in detail, especially in the matters of shape, size, and arrangement of parts within the principles of the exemplary disclosure to the full extent indicated by the broad general meaning of the terms in which the appended claims are expressed.

What is claimed is:

1. A detection unit comprising:

a magnet;

a first magnetic switch predetermining a first magnetic threshold, the first magnetic switch outputting a first control signal if magnetic flux density of the magnet is greater than the first predetermined magnetic threshold, and outputting a second control signal according if the magnetic flux density of the magnet is less than the first predetermined magnetic threshold;

a second magnetic switch predetermining a second magnetic threshold, the first magnetic switch outputting a third control signal if the magnetic flux density of the magnet is greater than the second predetermined magnetic threshold, and outputting a fourth control signal according if the magnetic flux density of the magnet is less than the second predetermined magnetic threshold, the first control signal being the same as the third control signal, the second control signal being the same as the fourth control signal;

a processor electronically connected to the first magnetic switch and the second magnetic switch; and a clock electronically connected to the processor;

in response to receiving the first control signal and the third control signal from the first magnetic switch or the second magnetic switch, the processor reads a first real-time clock (RTC) signal from the clock; and in response to receiving the first control signal and the third control signal from the first magnetic switch or the second magnetic switch, the processor reads a second RTC signal from the clock.

2. The detection unit as claimed in claim 1, further comprising a radio frequency identification (RFID) tag electronically connected to the processor, wherein the RFID tag sends the first RTC signal and the second RTC signal from the processor to a RFID reader.

3. The detection unit as claimed in claim 1, wherein the second magnetic threshold is greater than the first magnetic threshold.

4. The detection unit as claimed in claim 3, wherein if the magnetic flux density of the magnet is greater than the first predetermined magnetic threshold, the first magnetic switch is enabled, and the first magnetic switch outputs the first control signal; if the magnetic flux density of the magnet is less than the first predetermined magnetic threshold, the first magnetic switch is disabled, and the first magnetic switch outputs the second control signal.

5. The detection unit as claimed in claim 3, wherein if the magnetic flux density of the magnet is greater than the second predetermined magnetic threshold, the second magnetic switch is enabled, and the second magnetic switch outputs the third control signal; if the magnetic flux density of the magnet is less than the second predetermined magnetic threshold, the second magnetic switch is disabled, and the second magnetic switch outputs the fourth control signal.

6. An anti-theft system used in a package, the anti-theft system comprising:

a magnet;

a first magnetic switch predetermining a first magnetic threshold, the first magnetic switch outputting a first control signal if magnetic flux density of the magnet is greater than the first predetermined magnetic threshold, and outputting a second control signal according if the magnetic flux density of the magnet is less than the first predetermined magnetic threshold;

a second magnetic switch predetermining a second magnetic threshold, the first magnetic switch outputting a third control signal if the magnetic flux density of the magnet is greater than the second predetermined magnetic threshold, and outputting a fourth control signal according if the magnetic flux density of the magnet is less than the second predetermined magnetic threshold, the first control signal being the same as the third control signal, the second control signal being the same as the fourth control signal;

a processor electronically connected to the first magnetic switch and the second magnetic switch; and a clock electronically connected to the processor;

wherein when the package is opened, the processor receives the second control signal and the fourth control signal at the same time, and reads a real-time clock (RTC) signal from the clock accordingly.

7. The anti-theft system as claimed in claim 6, wherein the second magnetic threshold is greater than the first magnetic threshold.

8. The anti-theft system as claimed in claim 7, wherein if the package is closed, the magnetic flux density of the magnet applied to the first magnetic switch and the second magnetic switch is greater than the first predetermined magnetic threshold of the first magnetic switch and less than the second predetermined magnetic threshold of the second magnetic switch.

9. The anti-theft system as claimed in claim 8, wherein if the package is opened, the magnetic flux density of the magnet applied to the first magnetic switch and the second magnetic switch is less than the first predetermined magnetic threshold of the first magnetic switch.

10. The anti-theft system as claimed in claim 9, wherein if the magnetic flux density is greater than the first predetermined magnetic threshold, the first magnetic switch is enabled, and the first magnetic switch outputs the first control signal; if the magnetic flux density is less than the first predetermined magnetic threshold, the first magnetic switch is disabled, and the first magnetic switch outputs the second control signal.

11. The anti-theft system as claimed in claim 9, wherein if the magnetic flux density is greater than the second predetermined magnetic threshold, the second magnetic switch is enabled, and the second magnetic switch outputs the third control signal; if the magnetic flux density is less than the second predetermined magnetic threshold, the second magnetic switch is disabled, and the second magnetic switch outputs the fourth control signal.

12. The anti-theft system as claimed in claim 6, further comprising a radio frequency identification (RFID) tag electronically connected to the processor, wherein the RFID tag sends the RTC signal from the processor to a RFID reader.

13. The anti-theft system as claimed in claim 6, wherein the package includes an opening, two first covers and two second covers, the two first covers and two second covers are arranged alternately for covering the opening, the first magnetic switch and the second magnetic switch are positioned at one of the two first covers, the magnet is poisoned at one of the two second covers.

* * * * *